US009192964B2

(12) United States Patent
Vroom et al.

(10) Patent No.: US 9,192,964 B2
(45) Date of Patent: Nov. 24, 2015

(54) MATERIAL REDUCING APPARATUS HAVING FEATURES FOR ENHANCING REDUCED MATERIAL SIZE UNIFORMITY

(75) Inventors: Daniel James Vroom, Pella, IA (US); Duane Harthoorn, Lynville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 520 days.

(21) Appl. No.: 13/590,402

(22) Filed: Aug. 21, 2012

(65) Prior Publication Data

US 2013/0098811 A1 Apr. 25, 2013

Related U.S. Application Data

(62) Division of application No. 12/795,886, filed on Jun. 8, 2010, now Pat. No. 8,245,961.

(60) Provisional application No. 61/185,100, filed on Jun. 8, 2009.

(51) Int. Cl.

| | |
|---|---|
| ***B02C 23/00*** | (2006.01) |
| ***B07B 1/46*** | (2006.01) |
| ***B02C 13/284*** | (2006.01) |
| ***B02C 19/20*** | (2006.01) |
| ***B02C 23/10*** | (2006.01) |
| *B02C 13/00* | (2006.01) |
| *B02C 23/16* | (2006.01) |

(52) U.S. Cl.

CPC ..... *B07B 1/46* (2013.01); *B02C 13/284* (2013.01); *B02C 19/20* (2013.01); *B02C 23/10* (2013.01); *B02C 13/00* (2013.01); *B02C 2023/165* (2013.01)

(58) Field of Classification Search

CPC .. B02C 23/08; B02C 23/10; B02C 2023/165; B02C 13/00; B02C 13/284; B02C 23/16; B07B 1/20

USPC ..... 241/73, 189.1, 186.35; 209/428, 606

See application file for complete search history.

(56) References Cited

U.S. PATENT DOCUMENTS

| | | | | |
|---|---|---|---|---|
| 2,946,523 | A * | 7/1960 | Phillips | 241/89.2 |
| 3,090,568 | A * | 5/1963 | Wetmore | 241/73 |
| 3,542,302 | A | 11/1970 | Salzmann, Jr. | |
| 3,861,602 | A | 1/1975 | Smith | |
| 4,049,206 | A | 9/1977 | Konig et al. | |

(Continued)

FOREIGN PATENT DOCUMENTS

| | | |
|---|---|---|
| JP | 2006-192377 | 7/2006 |
| WO | WO 2008/140953 | 11/2008 |

(Continued)

OTHER PUBLICATIONS

International Search Report and Written Opinion mailed Mar. 9, 2011 (re PCT/US2010/037744; WO2010/144427).

*Primary Examiner* — Faye Francis

(74) *Attorney, Agent, or Firm* — Merchant & Gould P.C.

(57) ABSTRACT

The present disclosure relates to a material reducing machine including a rotary reducing component positioned at least partially within a reducing chamber. A sizing screen defines a portion of the reducing chamber and extends at least partially around the rotary reducing component. Material catches are disclosed for preventing elongated strips of material from snaking longitudinally through the sizing screen without being adequately reduced in length.

12 Claims, 10 Drawing Sheets

(56) References Cited

U.S. PATENT DOCUMENTS

| | | | | |
|---|---|---|---|---|
| 4,442,877 | A | 4/1984 | Ultermarkt | |
| 4,449,673 | A | 5/1984 | Cameron | |
| 4,773,601 | A | 9/1988 | Urich et al. | |
| 4,958,775 | A | 9/1990 | Arasmith | |
| 5,005,620 | A | 4/1991 | Morey | |
| 5,088,532 | A | 2/1992 | Eggers et al. | |
| 5,392,540 | A | 2/1995 | Cooper et al. | |
| 5,419,502 | A | 5/1995 | Morey | |
| 5,507,441 | A | 4/1996 | De Boef et al. | |
| 5,526,988 | A * | 6/1996 | Rine | 241/23 |
| 5,692,548 | A | 12/1997 | Bouwers et al. | |
| 5,692,549 | A | 12/1997 | Eggers | |
| 5,803,380 | A | 9/1998 | Brand et al. | |
| 5,881,959 | A | 3/1999 | Hadjinian et al. | |
| 5,947,395 | A | 9/1999 | Peterson et al. | |
| 5,950,942 | A | 9/1999 | Brand et al. | |
| 5,975,443 | A | 11/1999 | Hundt et al. | |
| 6,116,529 | A | 9/2000 | Fisher et al. | |
| 6,138,932 | A | 10/2000 | Moore | |
| 6,189,820 | B1 | 2/2001 | Young | |
| 6,230,770 | B1 | 5/2001 | Spaargaren | |
| 6,290,115 | B1 | 9/2001 | Chen | |
| 6,290,155 | B1 | 9/2001 | Thompson et al. | |
| 6,299,082 | B1 | 10/2001 | Smith | |
| 6,412,715 | B1 | 7/2002 | Brand et al. | |
| 6,422,495 | B1 | 7/2002 | De Boef et al. | |
| 6,446,889 | B1 | 9/2002 | Moore | |
| 6,637,680 | B1 | 10/2003 | Young | |
| 6,742,732 | B1 | 6/2004 | Hundt et al. | |
| 6,840,471 | B2 | 1/2005 | Roozeboom et al. | |
| 6,843,435 | B2 | 1/2005 | Verhoef et al. | |
| 6,871,807 | B2 | 3/2005 | Rossi, Jr. | |
| 6,978,955 | B2 | 12/2005 | Verhoef et al. | |
| 7,011,258 | B2 | 3/2006 | O'Halloran et al. | |
| 7,040,558 | B2 | 5/2006 | Stelter et al. | |
| 7,044,409 | B2 | 5/2006 | Stelter et al. | |
| 7,077,345 | B2 | 7/2006 | Byram et al. | |
| 7,204,442 | B2 | 4/2007 | Roozeboom et al. | |
| 7,213,779 | B2 * | 5/2007 | Roozeboom et al. | 241/88 |
| 7,232,083 | B2 | 6/2007 | Stelter et al. | |
| 7,441,719 | B2 | 10/2008 | Verhoef et al. | |
| 7,448,567 | B2 | 11/2008 | Roozeboom | |
| 7,461,802 | B2 | 12/2008 | Smidt et al. | |
| 7,461,832 | B2 | 12/2008 | Zhang | |
| 8,245,961 | B2 | 8/2012 | Vroom et al. | |
| 2003/0057306 | A1 | 3/2003 | Alford et al. | |
| 2004/0112999 | A1 | 6/2004 | Byram et al. | |
| 2005/0184178 | A1 | 8/2005 | Smidt et al. | |
| 2007/0176034 | A1 | 8/2007 | Roozeboom | |
| 2008/0061176 | A1 | 3/2008 | Smith | |
| 2008/0226784 | A1 * | 9/2008 | Matthews | 426/443 |
| 2010/0206973 | A1 | 8/2010 | Cotter et al. | |

FOREIGN PATENT DOCUMENTS

| | | |
|---|---|---|
| WO | WO 2010/129268 | 11/2010 |
| WO | WO 2010/144427 | 12/2010 |

* cited by examiner

MATERIAL REDUCING APPARATUS HAVING FEATURES FOR ENHANCING REDUCED MATERIAL SIZE UNIFORMITY

CROSS-REFERENCE TO RELATED APPLICATIONS

This application is a divisional of application Ser. No. 12/795,886, filed Jun. 8, 2010, now issued as U.S. Pat. No. 8,245,961, which claims the benefit of provisional application Ser. No. 61/185,100, filed Jun. 8, 2009, which applications are incorporated herein by reference in their entirety.

TECHNICAL FIELD

The present disclosure relates generally to material reducing machines. In particular, the present disclosure relates to material reducing machines such as grinders and chippers.

BACKGROUND

Material reducing machines are used to reduce waste materials such as trees, brush, stumps, pallets, root balls, railroad ties, peat moss, paper, wet organic materials and the like. Two common types of material reducing machines include grinders and chippers. Grinders are typically configured to reduce material through blunt force impactions. Thus, the reduced material product generated by grinders generally has a ground, flattened texture with relatively high fines content. This type of reduced material is typically used as mulch. In contrast to the blunt force action used by grinders, chippers reduce material through a chipping action. The reduced product generated by chippers preferably has a relatively small percentage of fines. This type of chipped reduced product can readily be used as fuel for a burner since the material is more flowable than ground reduced material and can easily be handled by the material processing equipment used to feed fuel to a burner.

Two common types of grinders include tub grinders and horizontal grinders. Example horizontal grinders are disclosed in U.S. Pat. Nos. 7,461,832; 7,441,719; 5,975,443; 5,947,395; 6,299,082; and 7,077,345. Example tub grinders are disclosed in U.S. Pat. Nos. 5,803,380; 6,422,495; and 6,840,471. Example wood chippers are disclosed in U.S. Pat. Nos. 5,692,548; 5,692,549; 6,290,115; 7,011,258; 5,005,620; 3,542,302; and 3,861,602.

Grinders typically include reducing hammers on which replaceable grinding cutters (i.e., grinding tips or grinding elements) are mounted. Grinding cutters generally have relatively blunt ends suitable for reducing material through blunt force impactions. In contrast to the grinding cutters used on grinders, chippers typically include relatively sharp chipping knives configured to reduce material through a cutting/slicing action as opposed to a grinding action. An advantage of grinders is that grinders are generally suited to better tolerate wear than chippers without unduly negatively affecting the performance of the grinders and quality of the product output by the grinders. An advantage of chippers is that the sharpness of the chipping knives allows certain materials (e.g., trees) to be processed more rapidly with less power than would typically be required by a grinder.

The reduced products generated by chippers and grinders can be used for a variety of applications. For example, the reduced product is often used as mulch and is also used as fuel for a burner. For at least some of these applications, it is desirable for the reduced material to have pieces of generally uniform size.

SUMMARY

Certain aspects of the present disclosure relate to catch configurations for preventing elongate debris from snaking longitudinally through the screen of a reducing machine without being suitably reduced in length. In certain embodiments, baffles with catches can be provided.

Another aspect of the present disclosure relates to a material reducing machine having features that enhance the size uniformity of the reduced product generated by the material reducing machine. In one embodiment, the material reducing machine includes a sizing screen and a plurality of material catches positioned upstream from sizing openings of the sizing screen.

Still another aspect of the present disclosure relates to a sizing unit for a material reducing machine. The sizing unit includes a frame supporting a plurality of solid slats at an upstream end of the frame. The sizing unit also includes a plurality of perforated slats positioned on the frame downstream from the solid slats. The slats are positioned in a stepped configuration relative to one another. Steps at downstream edges of the solid slats are adapted to force elongate strips of material back into the path of a rotary reducing component prior to passing through the holes of the perforated slats. In this way, the sizing unit is configured to enhance the size uniformity of the reduced product generated by the material reducing machine by reducing the likelihood for the elongated strips of material from passing lengthwise through the perforated slats without being adequately reduced in length.

A further aspect of the present disclosure relates to a material reducing machine including a rotary reducing unit mounted within a reducing chamber. The material reducing machine defines a receiving region for receiving a sizing unit. The sizing unit includes a sizing screen and a material catch structure carried with the sizing screen when the sizing unit is inserted into or removed from the receiving region. When the sizing unit is mounted within the receiving region, the sizing screen extends at least partially around the rotary reducing unit and defines at least a portion of the reducing chamber, and the material catch structure functions to snag elongated pieces of material to prevent the elongated pieces of material from snaking tangentially through the sizing screen without being adequately reduced in length.

Still another aspect of the present disclosure relates to a material reducing machine including a rotary reducing unit mounted within a reducing chamber. The rotary reducing unit includes a plurality of non-pivotal chipping knives. The material reducing machine also includes an anvil positioned at an entrance to the reducing chamber and a material catch structure positioned downstream from the anvil.

A variety of additional aspects will be set forth in the description that follows. The aspects can relate to individual features and to combinations of features. It is to be understood that both the foregoing general description and the following detailed description are exemplary and explanatory only and are not restrictive of the broad concepts upon which the embodiments disclosure herein are based.

DETAILED DESCRIPTION

Figure 1:
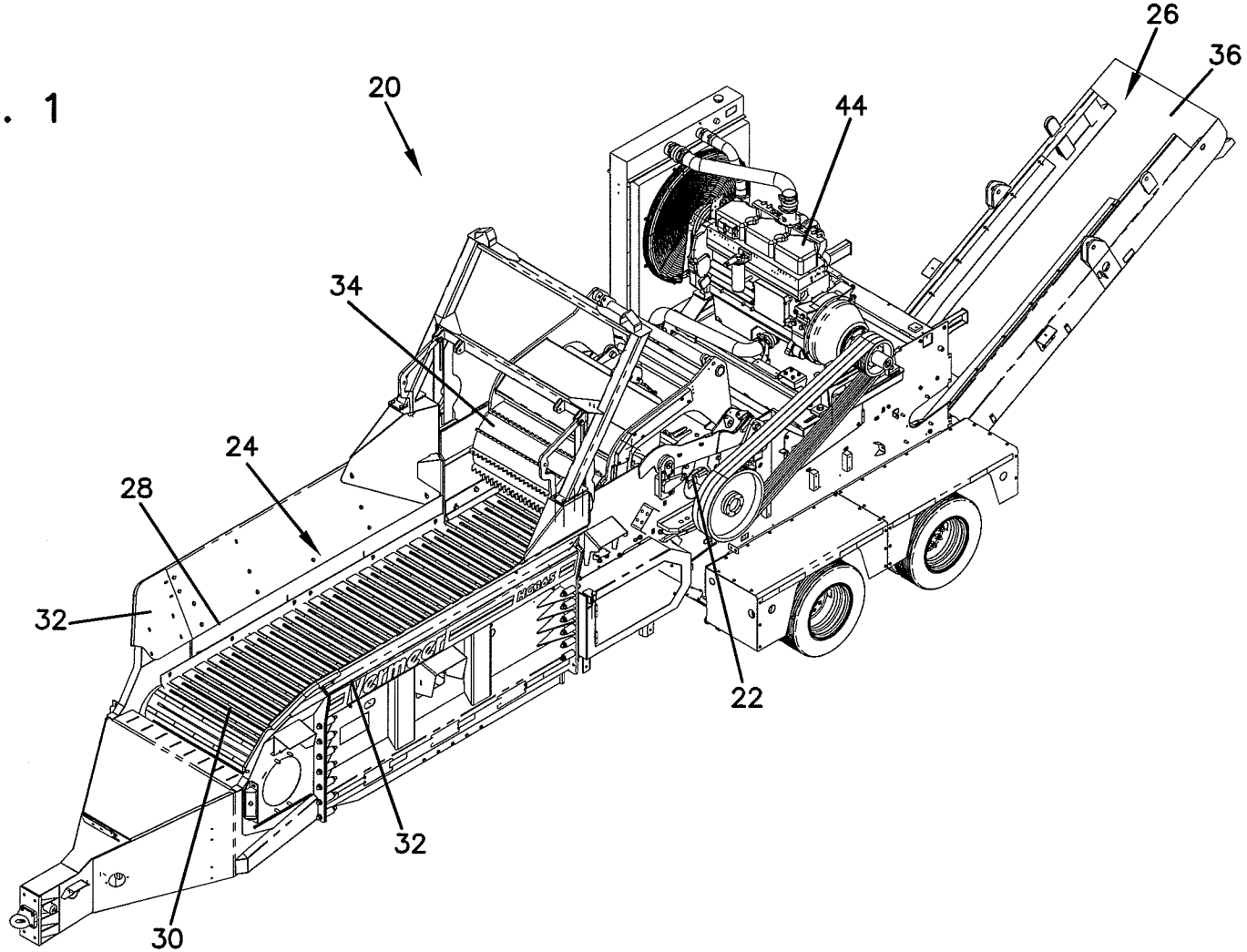
FIG. 1 illustrates a material reducing machine in accordance with the principles of the present disclosure.

FIG. 1 shows a material reducing machine 20 in accordance with the principles of the present disclosure. The material reducing machine 20 includes a material reducing chamber 22, a material in-feed arrangement 24 for feeding material desired to be reduced into the material reducing chamber 22, and a material out-feed arrangement 26 for carrying reduced product away from the material reducing chamber 22. The material in-feed arrangement 24 includes a material in-feed trough 28 having a floor 30 and side walls 32 positioned on opposite sides of the floor 30. The floor 30 is defined by a conveying arrangement such as a continuous conveyor (e.g., a belt, chain track or other conveying structure driven in a continuous loop) configured to feed material desired to be reduced into the material reducing chamber 22. The material in-feed arrangement 24 also includes an upper feed roller 34 that cooperates with the conveyor floor 30 to feed material into the material reducing chamber 22. The feed roller 34 can also function to grip material being fed into the material reducing chamber 22 to prevent the material from being pulled too quickly into material reducing chamber 22. The material out-feed arrangement 26 includes a discharge conveyor 36 that typically extends beneath the material reducing chamber 22. When material is reduced within the chamber 22, the material can fall from the material reducing chamber 22 onto the discharge conveyor 36 which carries the reduced product away from the material reducing chamber 22. The discharge conveyor 36 can be used to load the reduced material into a container such as the bed of a truck or in a pile on the ground.

Figure 2:
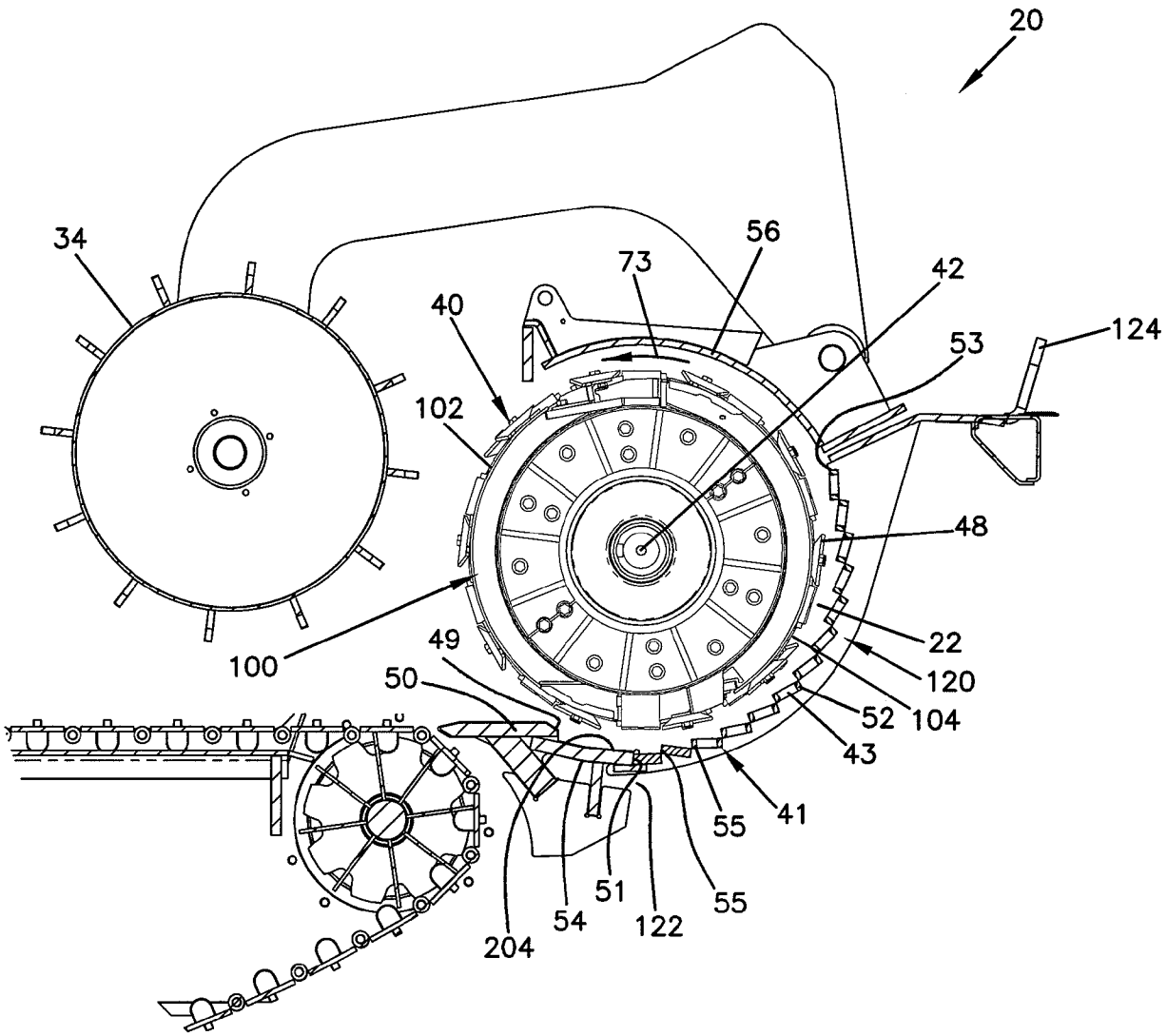
FIG. 2 is a cross-sectional view taken along section line 2-2 of FIG. 1.

Referring to FIG. 2, the material reducing machine 20 includes a rotary component 40 positioned within the material reducing chamber 22. The rotary component 40 is rotatable about a central longitudinal axis of rotation 42. Power for rotating the rotary component can be provided by an engine 44 (see FIG. 1) coupled to the rotary component 40 by a torque transferring arrangement (e.g., an arrangement of sheaves, belts, gears, shafts, chains or other known structures). As shown at FIG. 2, a plurality of chipping knives 48 is mounted to knife mounting locations 46 of the rotary component 40. The material reducing chamber 22 is defined by a surround or enclosure 41 that surrounds at least a portion of the rotary component 40. The enclosure 41 includes an anvil 50 that cooperates with outer portions of the chipping knives 48 of the rotary component 40 to define an in-feed nip or gap 49 for material desired to be reduced to be fed into the material reducing chamber 22. The enclosure 41 also includes a sizing screen 52 that extends around a portion of the rotary component 40. The sizing screen 52 defines a plurality of sizing openings 43 through which material reduced in the material reducing chamber 22 passes before falling onto the discharge conveyor 36. Pre-screening material catches 55 are positioned downstream from the anvil 50 and upstream from the openings 43 of the sizing screen 52. The pre-screening material catches 55 and the sizing screen are part of a sizing unit 120. The enclosure 41 further includes a transition plate 54 and a top cover plate 56. The transition plate 54 extends from the anvil 50 to a leading edge 51 of the reduced material sizing unit 120. The top cover plate 56 extends from a trailing 53 edge of the reduced material sizing unit 120 over a top side of the rotary component 40.

In use of the material reducing machine 20, material desired to be reduced is loaded into the material in-feed arrangement 24. The material in-feed arrangement 24 then feeds the material against the rotary component 40 while the rotary component 40 is rotated about the axis of rotation 42 in a counterclockwise direction as shown by arrow 73 provided at FIG. 2. As the material desired to be reduced is fed against the rotary component 40, the chipping knives 48 engage the material initially reducing the material and forcing the material through the in-feed gap 49 between the anvil 50 and the rotary component 40. Once inside the material reducing chamber 22, the material is further reduced by the chipping knives 48 and forced through the sizing holes 43 in the sizing screen 52. Thin, elongate material flowing along the wall of the reducing chamber (i.e., along a generally circumferential path about the axis of rotation) at a region beyond the outermost reach of the chipping knives 48 engages the pre-screening material catches 55 and is forced inwardly (i.e., closer to the axis of rotation 42) back into the paths of the chipping knives. In this way, the pre-screening material catches 55 prevent the thin, elongated material from snaking tangentially though the sizing holes 43 in the sizing screen 52 without being adequately reduced in size/length. From the sizing screen 52, the reduced material falls to the discharge conveyor 36 of the out-feed arrangement 26. The discharge conveyor 36 carries the reduced material to a material collection location.

As used herein, the phrase "mounted to" includes direct mounting configurations and indirect mounting configurations. An indirect mounting configuration is a mounting configuration in which one part is secured to another part through the use of one or more intermediate parts.

Figure 5:
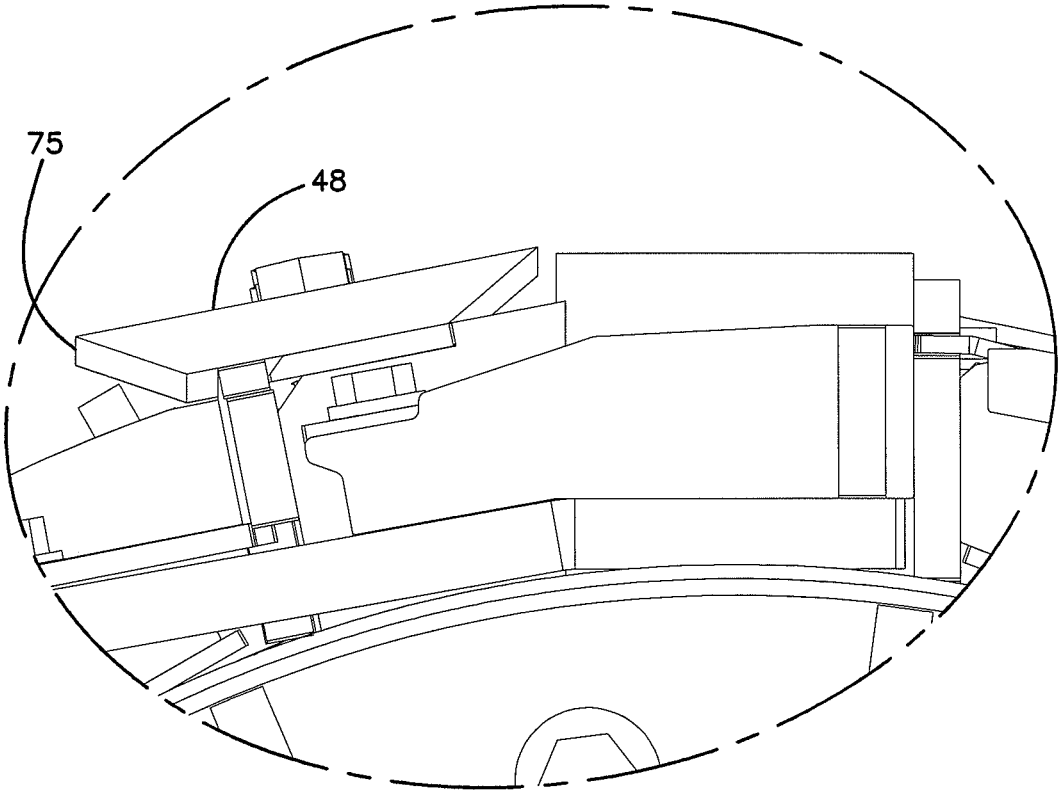
FIG. 5 is an enlarged view of an example chipping knife of the material reducing machine of FIG. 1.

The chipping knives 48 are preferably configured to reduce material through a chipping action. Referring to FIG. 5, the chipping knives 48 preferably have a cutting edge angle θ less than 60°. In another embodiment, the cutting edge angle θ is less than 45°. In still another embodiment, the cutting edge angle θ is in the range of 10° to 60°. In still a further embodiment, the cutting edge angle θ is in the range of 10° to 45°. In still a further embodiment, the cutting edge angle θ is in the range of 20° to 40°. In still another embodiment, the cutting edge angle θ is about 30°.

The rotary component 40 includes a drum 100 having an outer surface 102. The chipping knives 48 overhang chipping pockets 104 defined by the outer surface 102 of the drum 100. The chipping knives 48 are non-pivotally mounted to the remainder of the rotary component 40. The term "non-pivotally mounted" means that the chipping knives 48 are fixed relative to the remainder of the rotary component 40 during chipping operations (i.e., the chipping knives do not pivot during chipping operations). During chipping operations, contact between the outer surface of the drum 100 and the material being reduced limits the depth the chipping knives 48 can bite/penetrate into the material being reduced. Further details of the drum can be found at U.S. Provisional Patent Application No. 61/173,431, filed Apr. 28, 2009, that is hereby incorporated by reference in its entirety.

Referring to FIG. 2, the sizing screen 52 and the pre-screening material catches 55 are included as part of the sizing unit 120. The sizing unit removably mounts within a receiving region 122 of the material reducing machine 20. The receiving region 122 is located at least partially below the rotary component 40. The sizing unit 120 includes a lifting loop 124 for facilitating lowering the sizing unit 120 into the receiving region 122 and for lifting the sizing unit 120 from the receiving region 122. The sizing screen 52 and the pre-screening material catches 55 are carried together when the sizing unit 120 is lowered into the receiving region 122 and when the sizing unit 120 is lifted from the receiving region 122.

Figure 3:
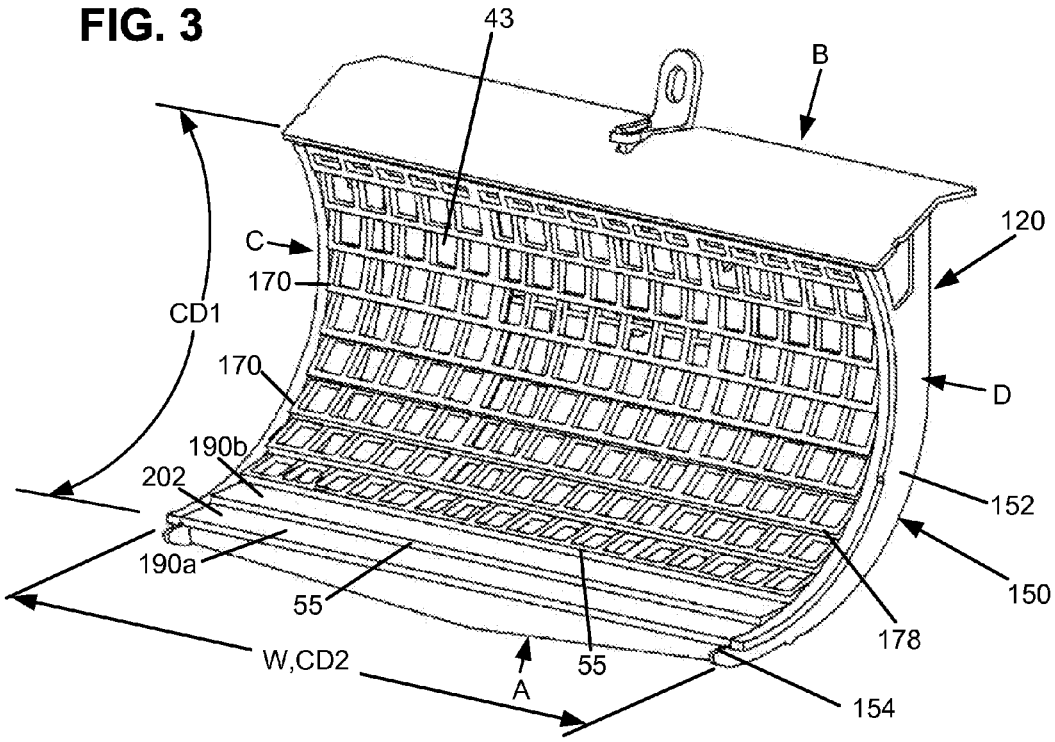
FIG. 3 is a perspective view of an example sizing unit that can be used with the material reducing machine of FIG. 1.
Figure 4:
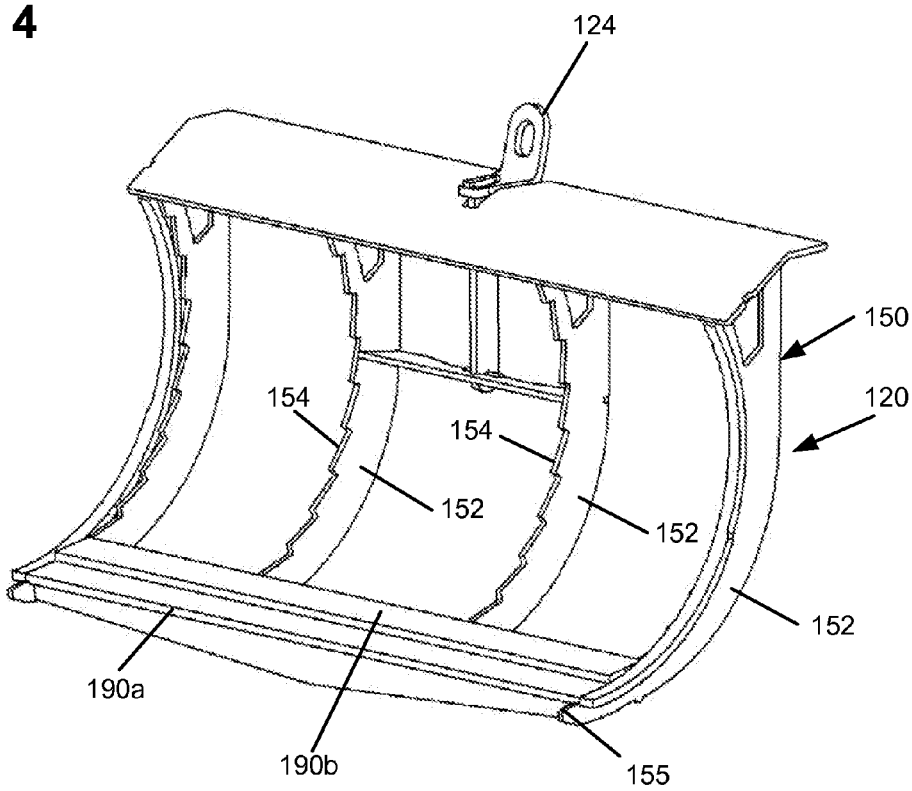
FIG. 4 shows the sizing unit of FIG. 3 with slats removed so as to illustrate an underlying frame for supporting the slats.

Referring to FIGS. 3 and 4, the sizing unit 120 includes a rigid framework 150 including a plurality of generally parallel, support plates 152. The framework 150 has a first cross-dimension CD1, that extends from a first end A, to a second end B. The support plates 152 can include end portions 155 that slide beneath a downstream end of the transition plate 54 (see FIG. 2) when the sizing unit 120 is lowered into the receiving region 122 to assist in maintaining alignment between the leading edge 51 (i.e., the upstream edge) of the sizing unit 120 and the downstream end of the transition plate 54. The support plates 152 have inner sides 154 that face toward the axis 42 when the sizing unit 120 is mounted within the receiving region 122. The inner sides 154 have stepped configurations and are shaped to curve generally circumferentially around the central axis 42 when the sizing unit 120 is mounted in the receiving region 122.

The sizing openings 43 of the sizing screen 52 are positioned downstream from the pre-screening material catches 55. In the depicted embodiment, the sizing screen 52 is formed by a plurality of screening slats 170 mounted to the inner sides 154 of the support plates 152. The sizing openings 43 of the sizing screen 52 are defined through the screening slats 170 with one row of the sizing openings 43 being defined through each screening slat 170. The rows of sizing openings 43 extend across a width W of the sizing screen 52. The width W can also be referred to as a second cross-dimension CD2 that extends between first and second sides C, D. The width W of the sizing screen 52 is measured along a dimension generally parallel to the central axis 42 of the rotary component 40. The support plates 152 orient the screening slats 170 such that the sizing screen 52 curves generally around the central axis 42 of the rotary component 40. As shown at FIG. 2, the screening slats 170 define a curvature that circumscribes the central axis 42 at a location spaced slightly radially outwardly from a reducing boundary defined by blade edges 75 of the chipping knives 48 as the rotary component 40 is rotated about the central axis 42. The support plates 152 also step the screening slats 170 relative to one another such that screening catches 178 are defined at the upstream faces of at least some of the screening slats 170. Screening catches are material catches located downstream of at least some sizing openings. The screening catches 178 include in-steps having heights that extend generally in a radial direction relative to the central axis 42 and lengths that extends across the width W of the sizing screen 52. The in-steps are formed by the upstream faces of the screening slats 170 and the heights of the in-steps equal the thicknesses of the screening slats 170. The screening catches 178 are spaced outside from the reducing boundary of the rotary component 40 and the chipping knives 48 pass directly over the screening catches 178 during chipping operations.

The sizing unit 120 also includes two blocking slats 190*a*, 190*b* positioned on the inner sides 154 of the support plates 152 at the upstream end of the reduced material sizing unit 120. The blocking slats 190*a*, 190*b* can have lengths that extend along the entire width W of the sizing screen 52. The blocking slats 190*a*, 190*b* are configured to prevent reduced material from passing there-through. In a preferred embodiment, the blocking slats 190*a*, 190*b* are free of any openings for allowing material to pass there-through. However, in certain embodiments, openings significantly smaller than the sizing openings 43 may be provided through the slats 190*a*, 190*b*. The blocking slat 190*a* can include an interior surface 202 that is generally flush with an interior surface 204 of the transition plate 54. The blocking slats 190*a*, 190*b* are positioned in stepped relation relative to one another by the support plates 152. A first one of the pre-screening catches 55 is formed by an upstream face of the blocking slat 190*b* and a second one of the pre-screening catches 55 is formed by an upstream face of the upstream-most screening slat 170. The pre-screening catches 55 include in-steps having heights that extend generally in a radial direction relative to the central axis 42 and lengths that extends across the entire width W of the sizing screen 52. The heights of the in-steps are equal the thicknesses of the slats 170, 190*a*, 190*b*. The catches 55 are spaced outside from the reducing boundary of the rotary component 40 and the chipping knives 48 pass directly over the catches 55 during chipping operations.

During chipping operations, elongated material moving over the transition plate 54 along a material flow path located outside the reducing boundary of the rotary component is caught on the material catches 55 and forced inwardly to a location inside the reducing boundary. The structure of the blocking slats 190*a*, 190*b* ensures that material that catches on the material catches 55 can not pass outwardly through the sizing unit 120 and instead is forced inwardly into the path of the rotating chipping knives 148 for further reduction.

The present disclosure relates to features for assisting in providing improved reduced material size uniformity. It will be appreciated that reduced material generated by machines in accordance with the present disclosure need not have perfectly uniform reduced product. Thus, it will be understood that reduced material generated from machines in accordance with the principles of the present disclosure will generate reduced product having a range of different sizes. However, certain features in accordance with the principles of the present disclosure are designed to reduce the likelihood for unacceptably large pieces of material from being output from the reducing machine.

It has been determined that certain types of material such as wood can be chipped or sheared in relatively long strips that can have a tendency to migrate along the reducing chamber 22 outside of the path of the chipping knives 48 and snake lengthwise through the sizing screen 52. Such strips of material can often have a length that is substantially longer than the dimensions of the sizing openings 43. The pre-screening material catches 55 are configured to prevent such strips from reaching the sizing openings 43 before being further reduced. Specifically, as such relatively large strips migrate in an upstream to downstream direction along the reducing chamber at a location outside the reducing boundary, the strips engage the material catches 55 and are caused to flex or bend back into the reducing path of the chipping knives 48. When the strips intersect the reducing boundary of the rotary reducing component 40, the strips are struck by the chipping knives 48 and are reduced to a more acceptable size before being passed through the sizing openings 43.

Figure 6:
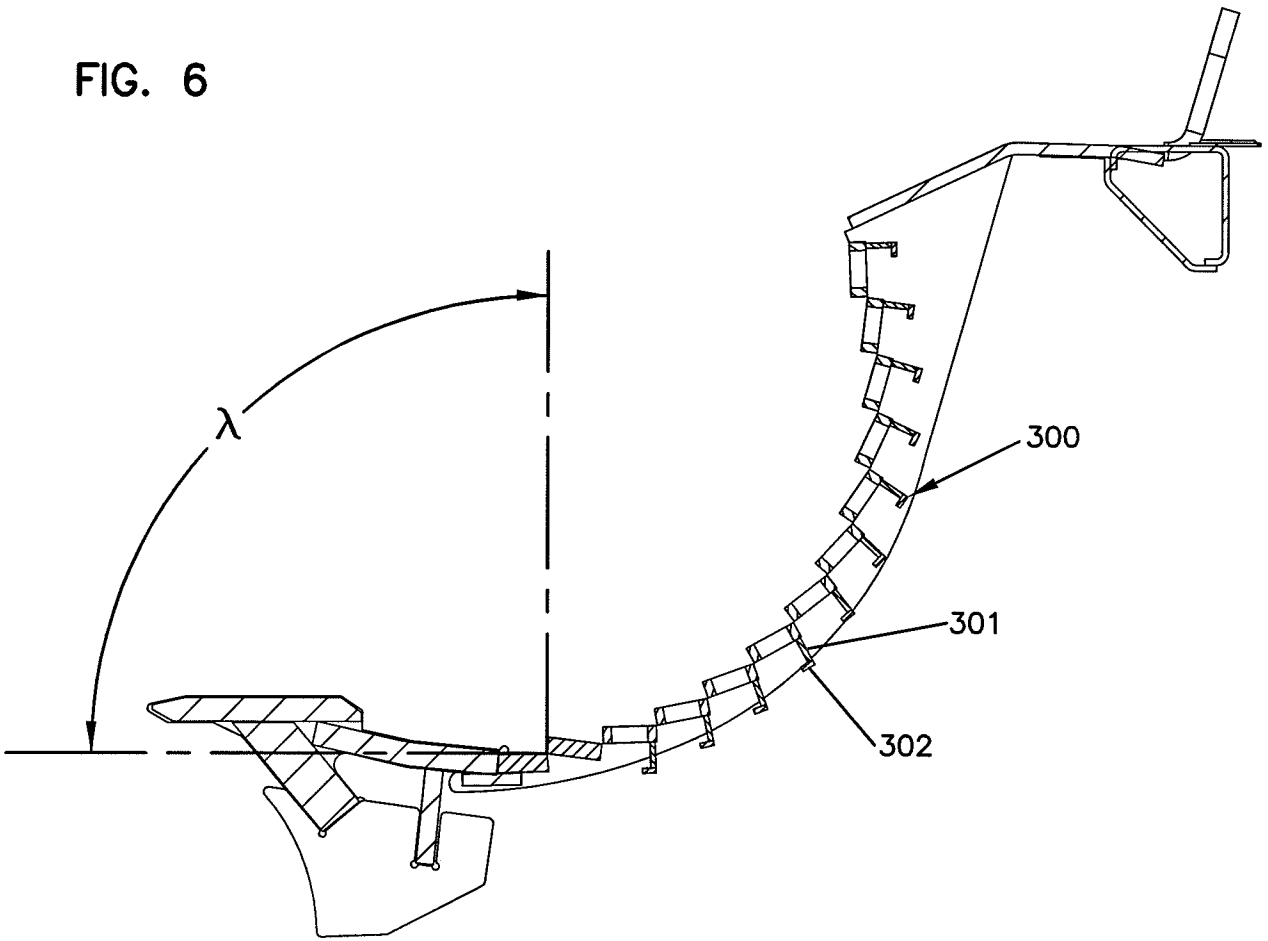
FIG. 6 shows an alternative configuration for a material catch.

As used herein, material catches are structures that oppose/obstruct/contact material flowing along the wall of the reducing chamber at a location outside a reducing boundary of the rotary component and cause the material to be forced the back into the reducing path of the rotary component. In certain embodiments, the catches project inwardly (i.e., toward the reducing boundary) from a wall of the reducing chamber at a rather abrupt angle λ (see FIG. 6) suitable for catching material. In certain embodiments, the angle λ is less than 135 degrees, or less than 120 degrees, or less than 110 degrees, or less than 100 degrees, or about 90 degrees. In other embodiments, material catches can include projections such as baffles 300 (see FIG. 6) positioned on the outside of the sizing screen at a location immediately downstream from a row of sizing openings. The baffles 300 can have "L-shaped" transverse cross-sections and can include catch portions 301 that project in an upstream direction from outer ends of leg portions 302. As shown at FIG. 6, the baffles 300 are used on a stepped screen with pre-screening material catches formed in part by solid slats. In other embodiments, the baffles 300 can be used without the pre-screening material catches and can also be used on non-stepped screens. The baffles 300 can be used with rotary reducing components having chipping knives and with rotary reducing components having grinding elements. In such embodiments, when an elongate piece of material begins to snake through one of the openings of the sizing screen in a generally tangential direction, the piece of material engages the outer baffle and the portion of the material still inside the reducing chamber is forced into the path of the rotary component. In other embodiments, the baffles need not be "L" shaped and the catch structures can be acutely or obliquely oriented relative to the leg structures of the baffles. Additionally, the legs of the baffles need not extend in a pure radial direction relative to the axis of rotation of the reducing component.

Figure 8:
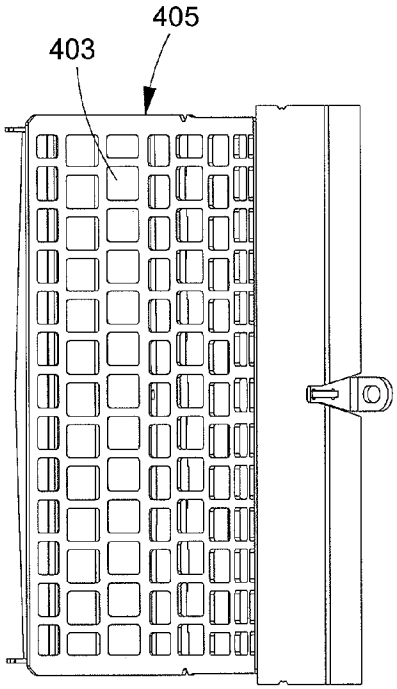
FIG. 8 shows a top view of the screen shown in FIG. 7.
Figure 7:
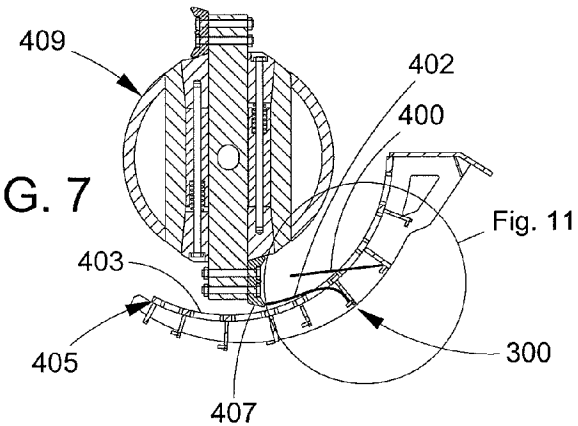
FIG. 7 shows a cross section of an alternative configuration with a material catch as shown in FIG. 6, but used with a different screen configuration, a plate screen with a variety of sizes of hole, and with a grinding drum with block cutters.
Figure 10:
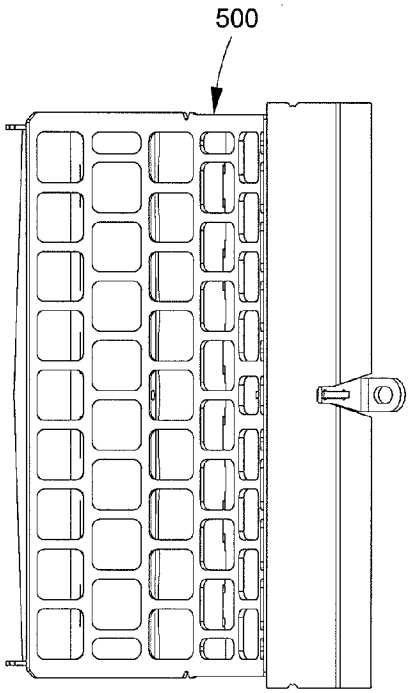
FIG. 10 shows a top view of the screen shown in FIG. 7.
Figure 9:
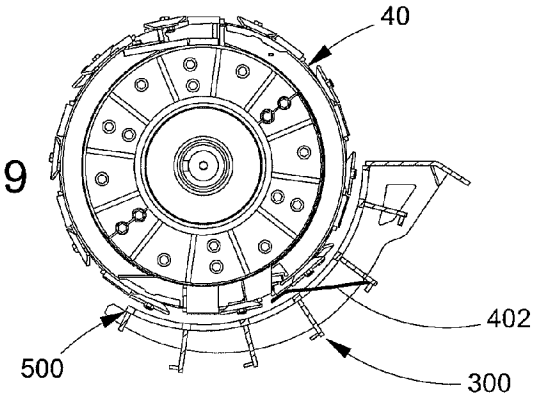
FIG. 9 shows a cross section of an alternative configuration with a material catch as shown in FIG. 6, but used with a different screen configuration, a plate screen with a consistent hole size, and with a grinding drum with shipping knives.

As an example FIG. 7 illustrates elongate material 402 snaking through an aperture 403 in a non-stepped, plate screen 405 and being stopped by the catch portion 301 of a baffle 300 and forced into contact with a grinding element 407 on a grinding drum 409. It also illustrates a second elongate piece of material 400 that has passed through a second aperture and contact with a baffle and catch, wherein it will be supported for contact with a grinding element. FIG. 8 illustrates a top view of the screen shown in FIG. 7, illustrating that a variety of sizes of apertures can be utilized, sometimes a variety of sizes on a screen, while at other times a screen 500 will have a consistent aperture size as illustrated in FIG. 10. FIG. 9 shows the screen 500 used in combination with the rotary component 40.

Figure 12:
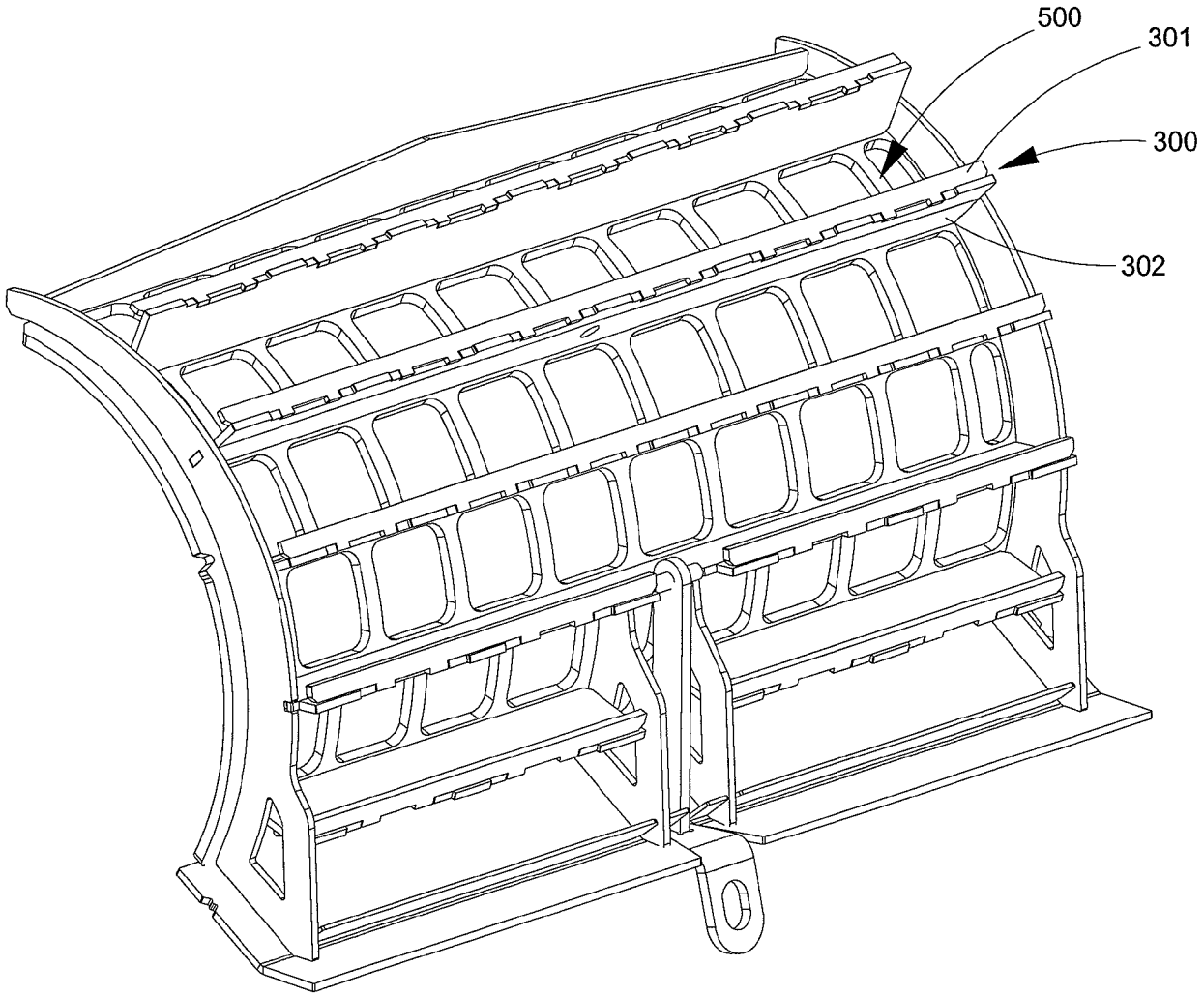
FIG. 12 is a perspective view showing the outer side of the screen of FIG. 9 with catch baffles attached thereto.

FIG. 12 is a perspective view showing the outer/under side of the screen 500 of FIG. 9. As shown at FIG. 12, the baffles 300 are positioned between rows of sizing openings with each baffle 300 positioned immediately downstream of a corresponding row of sizing openings. The baffles 300 are sized to extend along the entire lengths of the rows of openings (i.e., across the entire width or substantially the entire width of the sizing screen) such that each baffle prevents overly long material from passing through any of the openings of the row of openings positioned immediately upstream from the baffle without being suitably reduced in size. In other embodiments, the baffles 300 may extend across the openings such that portions of the openings are upstream from the baffles and portions are downstream from the baffles. In such a configuration, the baffles 300 prevent elongated material from snaking through the upstream portions of the openings.

Figure 11:
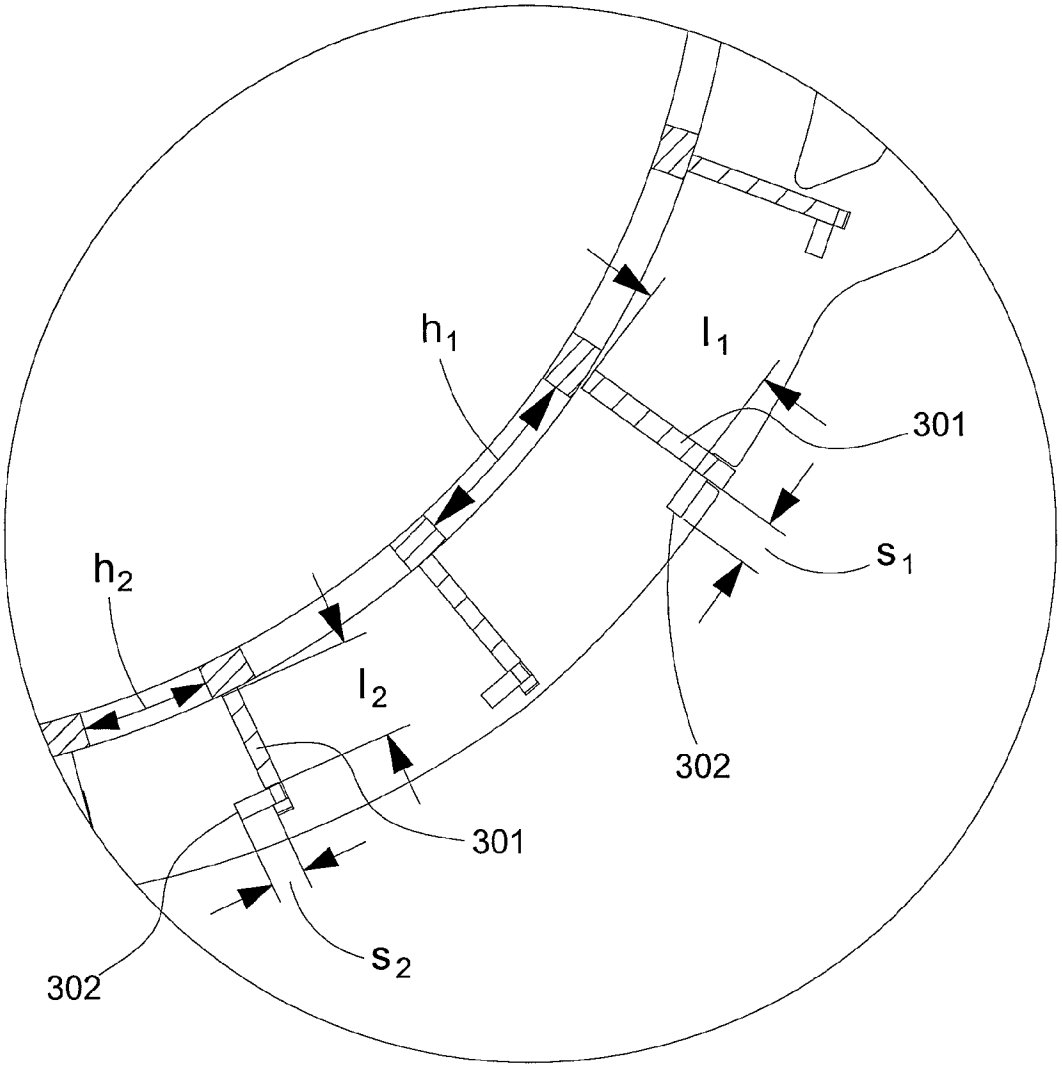
FIG. 11 shows an enlarged area of the screen shown in FIG. 7.

In certain embodiments, there is a relationship between the aperture opening size and the effective length of the baffle, as set by the position and size of the leg portions. These dimensions are illustrated in FIG. 11 and labeled as:

h=aperture size (measured generally in the direction of rotation of the reducing component)

l=effective length of baffle leg (measured generally in a radial direction relative to the axis of rotation of the reducing component)

s=length of the catch portions (measured generally in the direction of rotation of the reducing component)

This figure illustrates two combinations of relationships between these dimensions including a first aperture with size $h_1$=3.3 inches, $l_1$=2.53 inches and $s_1$=0.85 inches with a second aperture with $h_2$=2.34 inches, $l_2$=1.82 inches and $s_2$=0.625 inches.

The efficacy of the relationship of these dimensions will be dependent on many parameters including the type of material being processed, the type of drum and cutters being used, the speed of the drum, etc. In general it is believed that the relationship between the aperture size h and the effective length of the baffle 1 is important for proper function. The relationship h/l is preferably in a range between 1.0 and 2.0 or in the range of 1.1 to 1.5. In other embodiments, the ratio h/l is greater than 1.0, or greater than 1.1 or greater than 1.2. In still other embodiments, the ratio h/l is in the range of 1 to 3. The two illustrated examples show a preferred arrangement with h/l=approx 1.3. The length of the catch portion can be varied, typically ranging from a minimum of 0.5 inches to a maximum of 1.0 inches, with the longer catches typically being useful with the longer baffles. In the case where the baffle extends across a portion of screen aperture, the dimension h is measured from the upstream end of the aperture to the baffle. In the case where the baffle is located completely downstream of its corresponding screen aperture, the dimension h is measured from the upstream end to the downstream end of the screen aperture.

The configuration of the baffles and aperture sizes can easily be tailored in response to the type of drum being used, the type of material being processed to achieve a variety of characteristics of the sized material. This screen design compliments a variety of cutting technologies as illustrated in FIG. 7 with block cutters and FIG. 9 with chipping knives.

Material catches as disclosed herein can provides a material catching function that is effective across an entire width of the reducing chamber. In certain embodiments, one material catch extends across an entire width of a reducing chamber. In other embodiments, catch structures may include multiple catches spaced apart from one another in a upstream-to-downstream direction may cooperate to provide full catch coverage across the entire width of the reducing chamber.

While the depicted embodiments show material catches used in combination with sizing screens, it will be appreciated that other embodiments can use material catches without sizing screens. For example, material catches such as those formed by slats 190*a*, 190*b* can be positioned upstream of a large open region (e.g., similar to the open region defined by the frame work 150 of FIG. 4 prior to mounting the screening slats thereon). Such an embodiment is preferred for use with rotary reducing components including chipping knives. However, aspects of the present disclosure can be used with rotary reducing components including chipping knives or with rotary reducing components having grinding elements.

It will be appreciated that aspects of the present disclosure are applicable to any type of chipping or grinding equipment.

Figure 13:
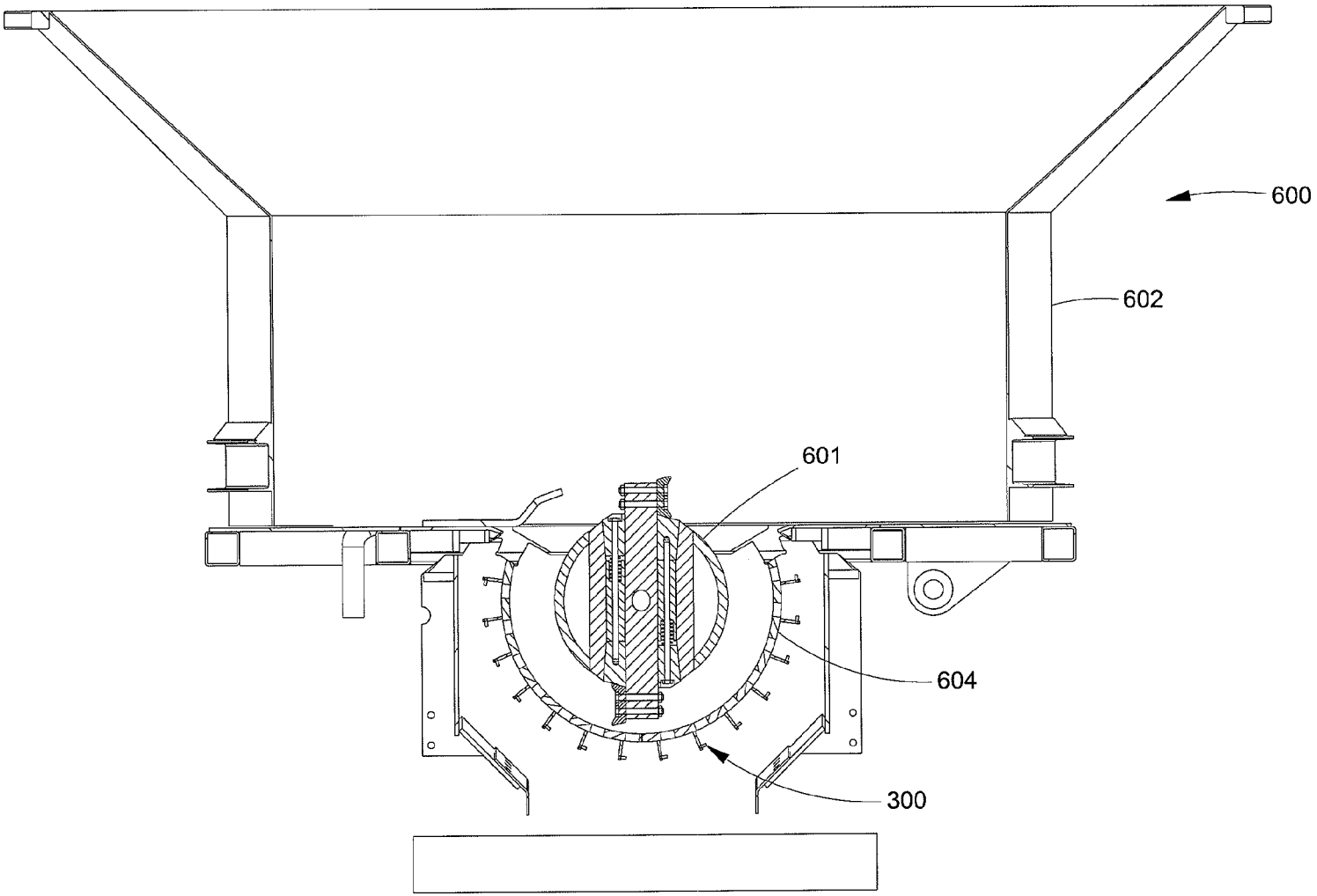
FIG. 13 shows a tub grinder having a sizing screen with material catches in accordance with the principles of the present disclosure.

FIG. 13 shows a tub grinder 600 having a rotatable grinding drum 601 mounted at the bottom of an open-topped tub 602. A sizing screen 604 is positioned below and at least partially surrounds the drum 601. Material catches such as baffles 300 are secured to the outside of the screen 604 to prevent elongated pieces of debris from snaking through the screen 604 without being adequately reduced in length.

The preceding embodiments are intended to illustrate without limitation the utility and scope of the present disclosure. Those skilled in the art will readily recognize various modifications and changes that may be made to the embodiments described above without departing from the true spirit and scope of the disclosure.

What is claimed is:

1. A material sizing unit for use with a material reducing machine, the material sizing unit comprising:

a frame having a first end and a second end;

at least two adjacent non-perforated slats mounted at the first end of the frame, the at least two non-perforated slats having a blocking arrangement to prevent reduced material from passing therethrough; and a plurality of screening slats affixed to the frame between the blocking arrangement and the second end of the frame;

the at least two adjacent non-perforated slats and the plurality of screening slats being supported on the frame so as to define a fixed curvature that extends around an axis parallel to lengths of both the at least two adjacent non-perforated slats and the plurality of screening slats.

2. The material sizing unit of claim 1, wherein the frame includes a lifting loop at the second end of the frame.

3. The material sizing unit of claim 1, wherein the plurality of screening slats are positioned in a stepped configuration relative to one another.

4. The material sizing unit of claim 3, wherein the step configurations are shaped to curve generally circumferentially around the axis.

5. The material sizing unit of claim 1, wherein the sizing unit further comprises support plates to carry and thereby orient the plurality of screening slats in the fixed curvature around the axis.

6. The material sizing unit of claim 5, wherein the support plates are generally parallel.

7. The material sizing unit of claim 5, wherein the support plates each include end portions.

8. The material sizing unit of claim 5, wherein the at least two adjacent non-perforated slats are held in step relation relative to one another by the support plates so as to form pre-screening material catches.

9. The material sizing unit of claim 8, wherein the pre-screening material catches include in-steps having heights that extend generally in a radial direction relative to the axis and lengths extending across the entire width of the sizing screen.

10. The material sizing unit of claim 9, wherein the heights of the in-steps equal the thicknesses of the slats.

11. A material sizing unit for use with a material reducing machine, the material sizing unit comprising:

a frame defining a first cross-dimension and a second cross-dimension, the first and second cross-dimensions being perpendicular relative to one another, the first cross-dimension extending from a first end to a second end of the frame and the second cross-dimension extending from a first side to a second side of the frame, the frame also including a plurality of parallel support members each having a length that extends along the first cross-dimension, the support members defining a plurality of steps positioned along a fixed curvature that extends about an axis that is parallel to the second cross-dimension, the fixed curvature extending along the first cross-dimension from the first end to the second end of the frame;

a plurality of elongate, parallel slats secured on the steps of the support members, the slats being fixed in position relative to one another along the fixed curvature defined by the frame, the slats having lengths that extend along the second cross-dimension from the first end to the second end of the frame, the slats including screening slats defining screening openings suitable for allowing reduced material to pass therethrough, the screening slats defining a screening region, the slats also including non-perforated slats that do not define screening openings and that define a blocking arrangement configured to prevent reduced material from passing therethrough, the non-perforated slats being positioned at the first end of the frame and the screening slats being positioned between the non-perforated slats and the second end of the frame such that the blocking region is defined at the first end of the frame and the screening region is defined between the blocking region and the second end of the frame; and a lifting loop located at the second end of the frame.

12. The material sizing unit of claim 11, wherein the slats are secured on the steps of the support members by welds.

* * * * *